US006733258B2

(12) United States Patent
Okada et al.

(10) Patent No.: US 6,733,258 B2
(45) Date of Patent: May 11, 2004

(54) GAS COMPRESSOR APPARATUS HAVING A DISCHARGE PULSATION REDUCING COOLER

(75) Inventors: Hiroshi Okada, Anjo (JP); Sota Shibasaki, Kariya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/270,529

(22) Filed: Oct. 16, 2002

(65) Prior Publication Data

US 2003/0077195 A1 Apr. 24, 2003

(30) Foreign Application Priority Data

Oct. 19, 2001 (JP) ..... 2001-322165
Jul. 23, 2002 (JP) ..... 2002-213818

(51) Int. Cl.[7] ..... F04C 29/04
(52) U.S. Cl. ..... 418/83; 418/85; 418/181; 418/201.1
(58) Field of Search ..... 417/312; 418/83, 418/85, 181, 201.1

(56) References Cited

U.S. PATENT DOCUMENTS 2,677,944 A * 5/1954 Ruff ..... 418/85
3,129,877 A * 4/1964 Nilsson et al. ..... 418/83
4,174,196 A 11/1979 Mori et al. ..... 418/85

FOREIGN PATENT DOCUMENTS

| | | | |
|---|---|---|---|
| JP | A-50-114605 | 9/1975 | |
| JP | 54-47113 | * 4/1979 | |
| JP | 62-261690 | * 11/1987 | ..... 418/181 |
| JP | 5-118290 | * 5/1993 | ..... 418/83 |

* cited by examiner

*Primary Examiner*—John J. Vrablik
(74) *Attorney, Agent, or Firm*—Posz & Bethards, PLC

(57) ABSTRACT

A discharge pulsation reducing cooler B is provided to cover the circumferential periphery of a compressor A. The discharge pulsation reducing cooler B has a delivery passage 41 and a jacket 43 covering that, and cooling water is circulated through a passage formed between the delivery passage 41 and the jacket 43. Delivered air flowing through the delivery passage 41 is cooled by the cooling water. In particular, because heat exchange efficiency is promoted by turbulence caused by the pulsation in the delivery passage 41, the delivered air is cooled efficiently. Also, pulsation is reduced in first and second expansion chambers 44, 45 in the delivery passage 41, and pulsation noise in the delivery passage 41 is reduced by the cooling water passage 42 and the jacket 43.

12 Claims, 13 Drawing Sheets

GAS COMPRESSOR APPARATUS HAVING A DISCHARGE PULSATION REDUCING COOLER

CROSS REFERENCES TO RELATED APPLICATIONS

This application relates to and incorporates by reference Japanese patent application number 2001-322165, which was filed on Oct. 19, 2001, and Japanese patent application number 2002-213818, which was filed on Jul. 23, 2002.

BACKGROUND OF THE INVENTION

This invention relates to a gas compressor apparatus using a compressor that produces discharge pulsation.

A compressor that compresses and delivers gas compresses the gas adiabatically, and consequently the delivered gas is hot. Because of this, problems arise if parts that are vulnerable to heat are present in devices to which the fluid (gas) is supplied, downstream of the compressor.

Known technology for solving this problem includes cooling the delivered fluid by injecting oil into the compression chamber of the compressor. With technology for cooling the delivered fluid by injecting oil into the compression chamber of the compressor, the temperature of the delivered fluid is lowered; however, because oil is mixed in with the fluid delivered from the compressor, if there are devices downstream of the compressor that are not oil-resistant or have poor resistance to oil, a device for removing the oil is necessary, and the overall construction becomes complicated.

Also, discharge pulsation from a compressor causes noise to be emitted from pipes connected to the compressor and is a major cause of compressor noise.

SUMMARY OF THE INVENTION

It is therefore an object of the present invention to provide a gas compressor apparatus in which the temperature of the delivered fluid is reduced without oil being mixed with the delivered fluid and in which discharge pulsation is reduced. Also, it is an object to provide a gas compressor apparatus that is reduced in size by integrating a delivered fluid cooling device and a discharge pulsation reducing device.

To achieve these and other objects, the invention essentially is a gas compressor apparatus that includes a compressor and a discharge pulsation reducing cooler, which is integral with the compressor. The discharge pulsation reducing cooler has a delivery passage, through which compressed gas flows, and a jacket, which covers the delivery passage. A cooling fluid flows between the jacket and the delivery passage.

By integrating the discharge pulsation reducing cooler with the compressor, not only can the compressed fluid be cooled, but the temperature of the compressor is prevented from rising due to heating of bearings and the like. Also, because discharge pulsation reduction and cooling can be achieved in the same space, the size of the gas compressor apparatus and the number of parts constituting the apparatus are reduced.

Also, the compressed fluid transfers heat to the cooling water and is cooled as it flows through the delivery passage of the discharge pulsation reducing cooler. Consequently, the temperature of the delivered fluid is lowered without mixing oil with the fluid.

In a second aspect of the invention, the gas compressor apparatus has, in the delivery passage covered by the jacket, an expansion chamber where the flow passage cross-sectional area increases. In the expansion chamber, pulsation is reduced efficiently. As a result, the discharge pulsation reducing cooler is relatively small and the gas compressor apparatus is relatively compact. Because the expansion chamber, which has a large pulsation-reducing effect, is covered with a jacket, the fluid is cooled by the cooling liquid even inside the expansion chamber. Consequently, the efficiency of heat exchange between the cooling liquid and the compressed fluid is high, and the delivered fluid is cooled efficiently. As a result, the discharge pulsation reducing cooler is relatively small and the gas compressor apparatus is relatively compact.

In a third aspect of the invention, the compressor apparatus has the expansion chamber in a downstream end of the delivery passage. In the delivery passage leading to the expansion chamber, because turbulence caused by pulsation arises, the efficiency of heat exchange between the delivered fluid and the cooling liquid inside the jacket is high, and the delivered fluid can be cooled efficiently. As a result, the discharge pulsation reducing cooler is relatively small and the gas compressor apparatus is relatively compact.

In a fourth aspect of the invention, the circumferential periphery of the compressor is covered by the discharge pulsation reducing cooler. In this case, because the path of propagation of noise emitted from the compressor proper is blocked by the discharge pulsation reducing cooler, noise is reduced.

In a fifth aspect of the invention, the discharge pulsation reducing cooler is provided in contact with a face of the compressor. In this case, piping connected to the compressor can be connected directly to the compressor, and piping connected to the discharge pulsation reducing cooler can be connected directly to the discharge pulsation reducing cooler. Consequently, compared to other variations, the piping layout and connection structure are simple. If the discharge pulsation reducing cooler is located on the face of the compressor from which the most noise is emitted, there is also a noise-reduction effect.

In a sixth aspect of the invention, the delivery passage covered by the jacket is curved so that the passage length inside the jacket is relatively long. By curving the delivery passage inside the jacket, extreme projections, which are undesirable when the apparatus is to be mounted in a vehicle, can be eliminated, and because, at the same time, discharge pulsation is reduced by the curved part, the discharge pulsation reducing cooler is relatively small, and the gas compressor apparatus is relatively compact. Further, because the heat exchange length over which the delivered fluid is cooled is relatively long, the heat transfer efficiency is increased without enlarging the device.

In a seventh aspect of the invention, the delivery passage covered by the jacket is curved so that compressed gas discharged from the compressor flows in a direction following a case of the compressor. In this case, because dead space around the compressor is used effectively, the gas compressor apparatus is relatively more compact.

In an eighth aspect of the invention, the discharge pulsation reducing cooler is made up of the delivery passage, which is covered by the jacket, and an expansion chamber, which is not covered by the jacket. The cross-sectional area of the expansion chamber is larger than that of the delivery passage. In this case, the jacket is not provided around the expansion chamber, and heat exchange is carried out only at the part of the delivery passage covered by the jacket. By not providing the jacket around the expansion chamber, where the flow passage cross-section is large, and by providing the jacket around the delivery passage, where the flow passage cross-section is smaller, the size of the discharge pulsation reducing cooler can be reduced, and the gas compressor apparatus can be more compact. By making the members forming the expansion chamber thick, it is possible to suppress noise emitted from the expansion chamber.

In a ninth aspect of the invention, the discharge pulsation reduction effect is increased by expansion chambers provided at both upstream and downstream ends of the delivery passage.

In a tenth aspect of the invention, to increase the discharge pulsation reduction effect with the same volume, the volume of the expansion chamber on the upstream side is made larger than that on the downstream side. By making the volume of the expansion chamber on the upstream side larger, it is possible to increase the reduction effect, particularly at lower frequencies of discharge pulsation.

In an eleventh aspect of the invention, to reduce discharge pulsation at a specific frequency at which discharge pulsation cannot be reduced just by changing the volume of the expansion chambers, an interfering muffler, which is effective in reducing discharge pulsation at the specific frequency, is built into the expansion chamber. By this, discharge pulsations over all frequencies can be reduced.

In a twelfth aspect of the invention, the compressor is a screw-type compressor, which compresses and delivers gas by rotation of a pair of mutually meshing rotors. In this case, because it is possible to commonize a passage through which a cooling liquid for cooling the compressed fluid flows and a passage through which a cooling liquid for suppressing operating noise of the compressor flows, the screw-type compressor apparatus can be made relatively compact.

In a thirteenth aspect of the invention, the screw-type compressor has a rotation transmission mechanism, for causing the pair of rotors to rotate in synchrony, and a lubricated box, which has a lubricant space in which the rotation transmission mechanism is housed and a lubricant is sealed. The lubricated box is covered by the jacket. In this case, the lubricant space and the delivered fluid, which in a screw-type compressor must be cooled, can be cooled using a common cooling liquid, and consequently the construction of the gas compressor apparatus can be simplified.

In a fourteenth aspect of the invention, the compressor apparatus has a construction wherein the cooling liquid flowing through the inside of the jacket is itself cooled. Consequently, the cooling of the delivered fluid and the compressor is stable.

DETAILED DESCRIPTION OF THE PREFERRED EMBODIMENTS

First Embodiment

FIGS. 1 through 5 show a first embodiment, in which a gas compressor apparatus combines a compressor A and a discharge pulsation reducing cooler B. In this embodiment, to facilitate understanding, the left sides of FIGS. 1, 2 will be referred to as the front, and the right sides of FIGS. 1, 2 will be referred to as the rear of the compressor apparatus.

The gas compressor apparatus is, for example, for supplying supercharging air to an engine of an automotive vehicle and is a combination of a compressor A for taking in, compressing and discharging air (an example of a gas fluid) and a discharge pulsation reducing cooler B, which covers the periphery of the compressor A, for simultaneously cooling and silencing the air discharged from the compressor A.

Figure 3:
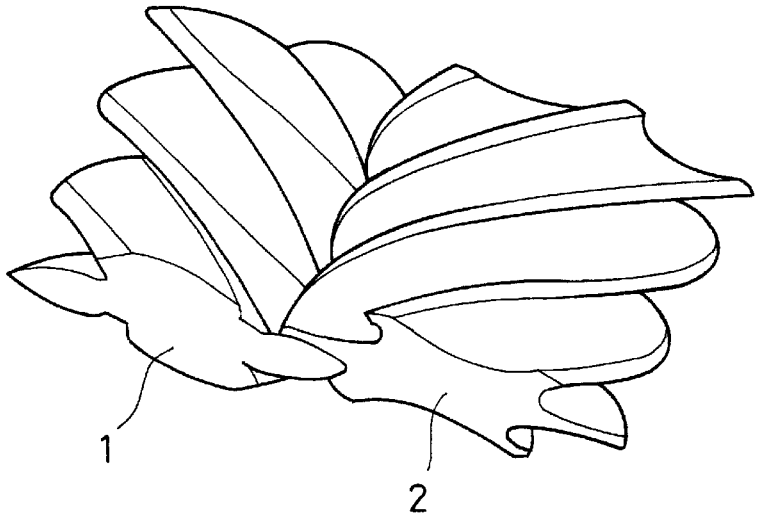
FIG. 3 is a perspective view of a pair of rotors of the compressor of FIG. 1.

As shown in FIG. 3, the compressor A is made up of a male rotor 1 and a female rotor 2 which mesh with each other (hereinafter, the rotors 1, 2), a rotation transmission mechanism 3 for driving the pair of rotors 1, 2, and a case 4 for separately housing the rotors 1, 2 and the rotation transmission mechanism 3.

The case 4 includes a lubricated box 6, a rotor housing 7, and a cover 8. These parts are strongly fixed together with bolts or the like (not shown). A lubricant space 9, which houses the rotation transmission mechanism 3, is formed inside the lubricated box 6, and a rotor chamber 10, which houses the rotors 1, 2, is formed inside the rotor housing 7. A splash lubricant (for example engine oil) is sealed in the lubricant space 9.

The lubricated box 6 supports an input shaft 5 on first and second bearings 11 and 12. A first oil seal 13, which prevents lubricant supplied to the first and second bearings 11, 12 from flowing to the outside, is fitted between the first and second bearings 11, 12 in hole that accommodates the input shaft 5.

A male rotor shaft 14 has one end supported by the rotor housing 7 by way of a third bearing 15 and one end supported by the cover 8 by way of a fourth bearing 16. A second oil seal 18, for preventing lubricant supplied to the third bearing 15 from leaking into the rotor chamber 10 through a hole accommodating the male rotor shaft 14, is fitted in a wall that separates the lubricant space 9 from the rotor chamber 10. A third oil seal 19, which prevents grease in the fourth bearing 16 from leaking into the rotor chamber 10, is fitted in a hole that accommodates the male rotor shaft 14 in the cover 8.

A female rotor shaft 20, like the male rotor shaft 14, has one end supported by the rotor housing 7 on a fifth bearing 21 and one end supported by the cover 8 by way of a sixth bearing 22. A fourth oil seal 23, for stopping lubricant supplied to the fifth bearing 21 from leaking into the rotor chamber 10 through a hole for the female rotor shaft 20, is fitted in the wall separating the lubricant space 9 from the rotor chamber 10. A fifth oil seal 24, for stopping grease in the sixth bearing 22 from leaking into the rotor chamber 10, is fitted in a hole for the female rotor shaft 20 in the cover 8.

The rotation transmission mechanism 3 is for transmitting rotation of the input shaft 5 to the male and female rotor shafts 14, 20 to synchronously rotate the rotors 1, 2 and is made up of first and second gears 31, 32 for transmitting rotation of the input shaft 5, which is driven by a motor M, to the male rotor shaft 14, and third and fourth gears 33, 34 for transmitting rotation of the male rotor shaft 14 to the female rotor shaft 20. The third and fourth gears 33, 34 are timing gears for rotating the rotors 1, 2 synchronously.

The rotors 1, 2 have the shapes shown in FIG. 3, and when they are rotated synchronously by the rotation transmission mechanism 3, they take in air through an intake opening 35 provided at the top of the front of the rotor housing 7 (the opposite side from the rotation transmission mechanism 3). The air is compressed in a compression chamber formed by the rotors 1, 2 and the rotor chamber 10. The compressed air moves from the front of the rotor chamber 10 to the rear as the rotors 1, 2 rotate. When the rotors 1, 2 have turned to a predetermined angle, a high-pressure compression chamber opens at a discharge port 36 provided at the bottom of the rear of the rotor housing 7 (the side near the rotation transmission mechanism 3), and by rotation of the rotors 1, 2 high-pressure compressed air is discharged through the discharge port 36. And because high-pressure air is discharged repeatedly into the discharge port 36 from the high-pressure compression chamber as the rotation of the rotors 1, 2 continues, a discharge pulsation arises in a delivery space of a delivery passage 41 (which will be further discussed later) connected to the discharge port 36.

Figure 1:
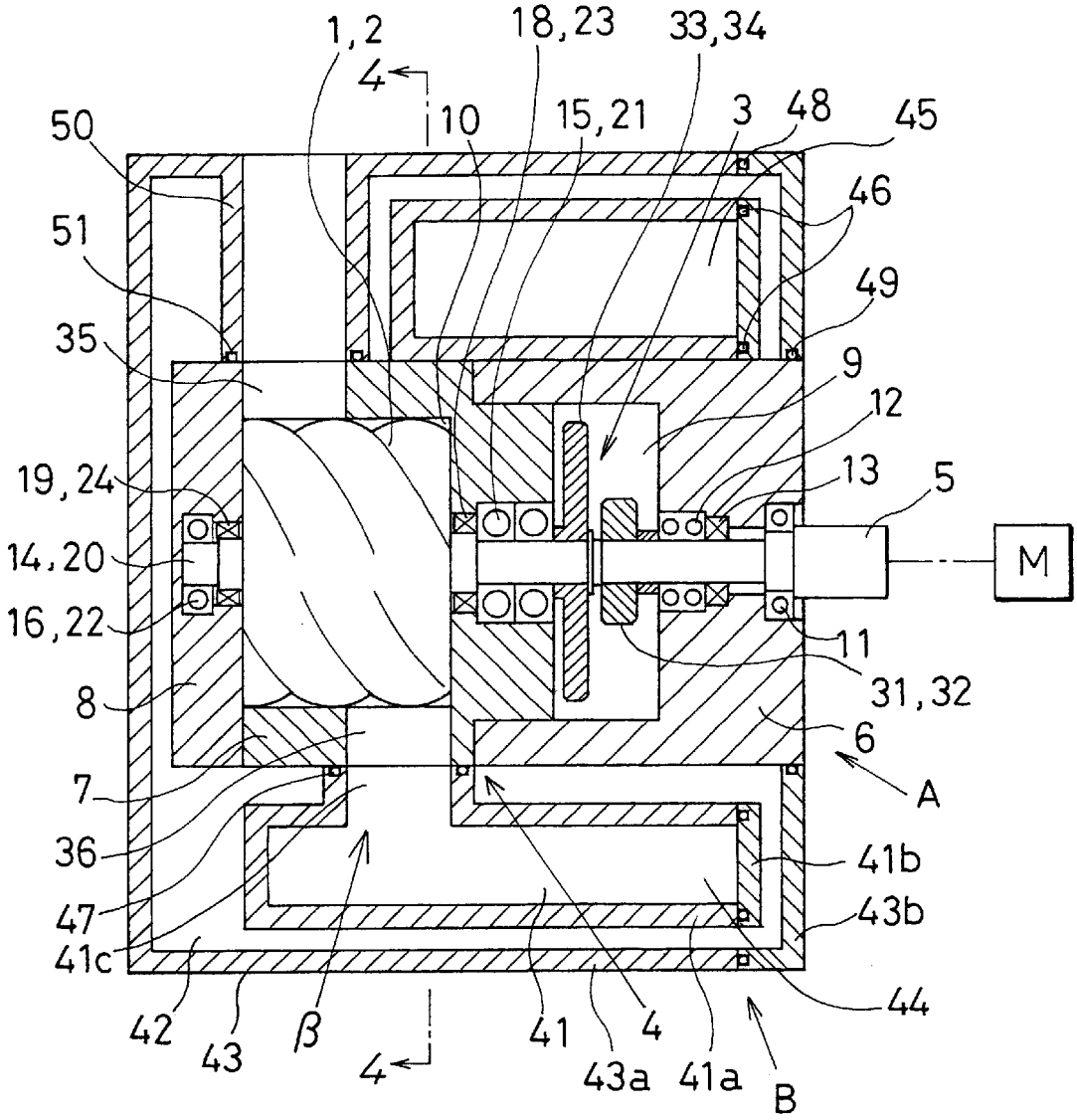
FIG. 1 is a sectional view of a gas compressor apparatus according to a first embodiment.
Figure 2:
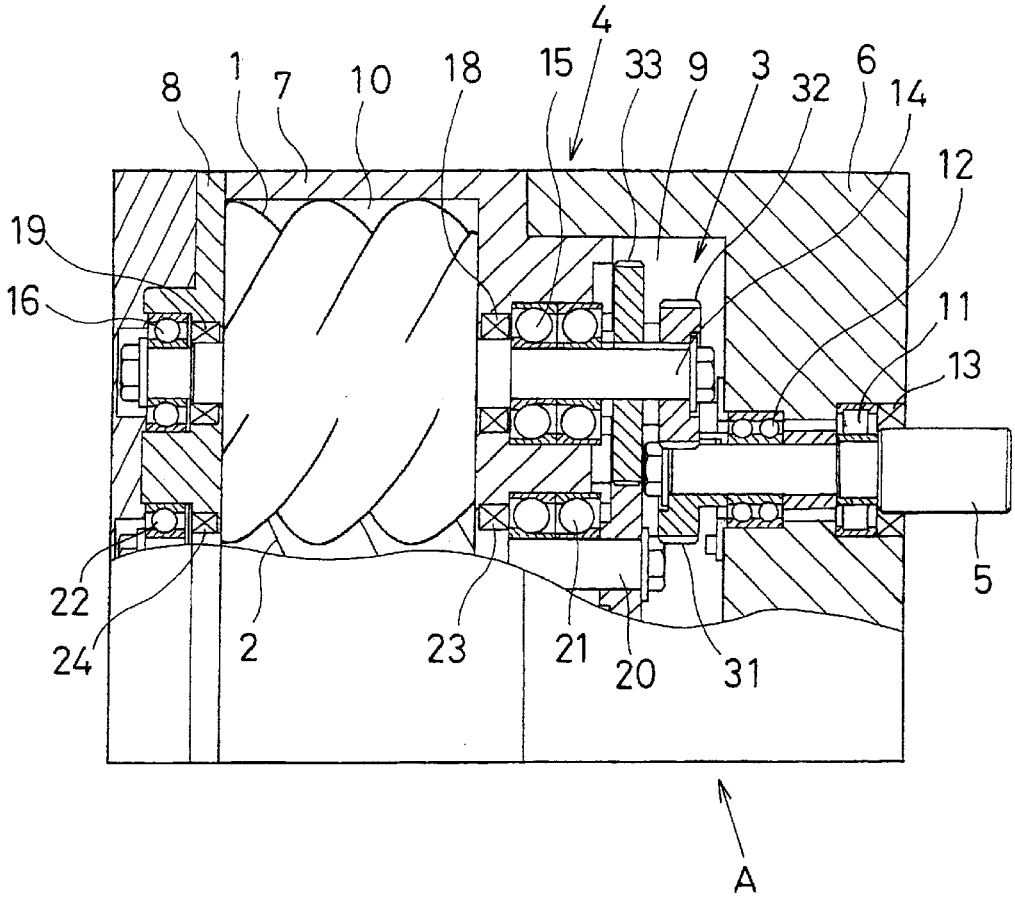
FIG. 2 is a sectional view of a compressor of the gas compressor apparatus.
Figure 4:
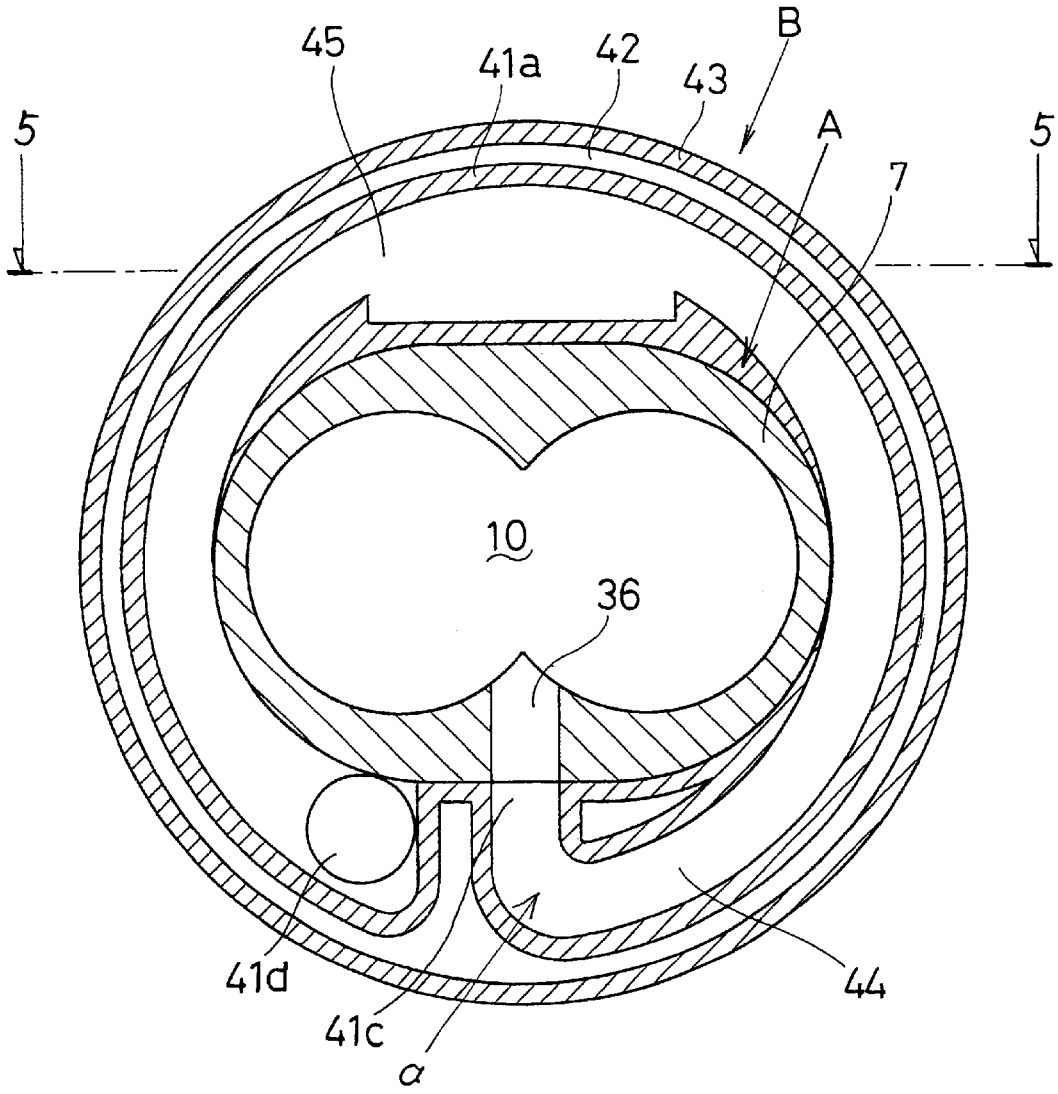
FIG. 4 is a sectional view taken along the line 4—4 in FIG. 1.

As shown in FIGS. 1 and 4, the discharge pulsation reducing cooler B is provided integrally with the compressor A to cover the circumferential periphery of the compressor A.

The discharge pulsation reducing cooler B is connected to the discharge port 36 of the compressor A and includes the delivery passage 41, through which flows compressed air, and a jacket 43, which forms a cooling water passage 42 through which cooling fluid flows.

Figure 5:
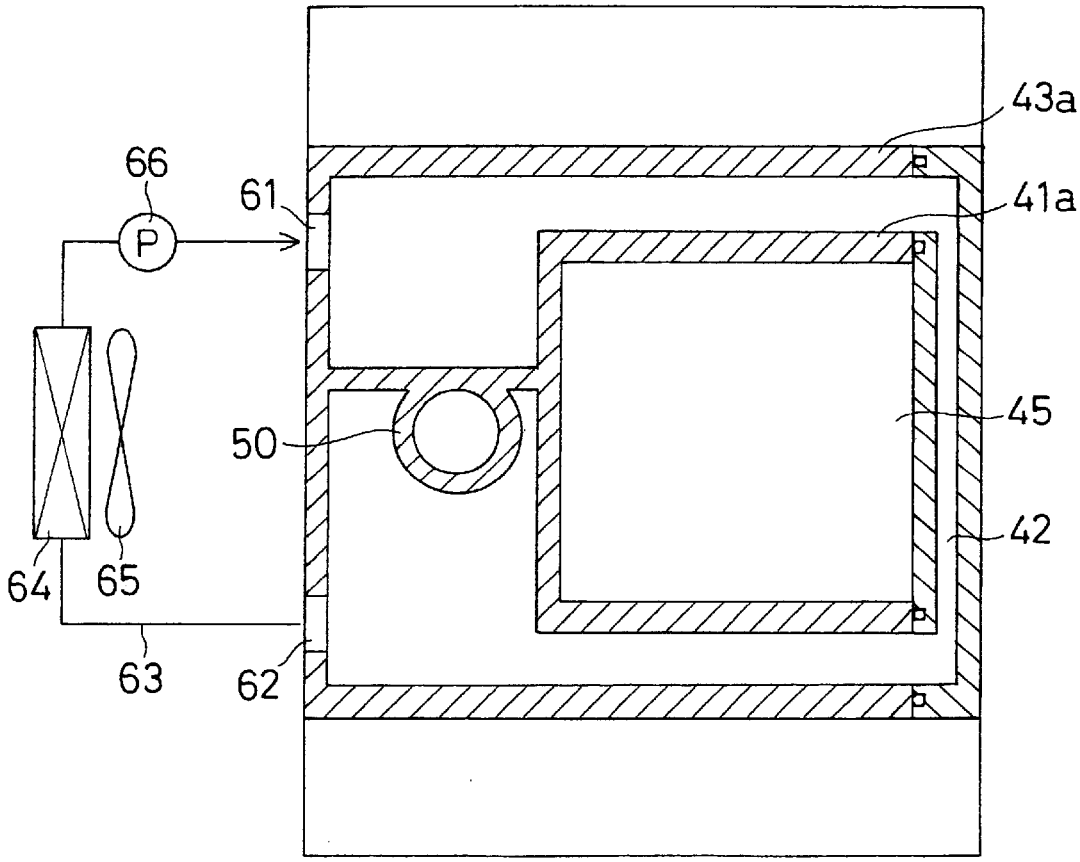
FIG. 5 is a sectional view taken along the line 5—5 in FIG. 4.

Cooling water of from engine is circulated through the cooling water passage 42 between the delivery passage 41 and the jacket 43. Specifically, as shown in FIG. 5, the cooling water in the cooling water passage 42 flows in through a cooling water inlet 61 formed in the jacket 43, through the cooling water passage 42 inside the jacket 43, and out through a cooling water outlet 62 formed in the jacket 43.

The cooling water flowing out through the cooling water outlet 62 is guided through a cooling liquid circulation path 63 to a radiator 64 and is cooled by a radiator fan 65. Cooling water cooled in the radiator 64 continues through the cooling liquid circulation path 63 and is returned into the cooling water passage 42 again through the cooling water inlet 61. The cooling water is circulated by a pump 66 provided in the cooling liquid circulation path 63. The cooling water, the radiator 64, the radiator fan 65 and the pump 66 in this embodiment are shared with an engine cooling circuit mounted in a vehicle; however, alternatively they may be provided separately from the engine cooling system.

Because a construction is employed wherein the cooling water is cooled by the radiator 64, the compressor A and the delivered air flowing through the discharge pulsation reducing cooler B can be cooled in a stable manner.

As described above, the discharge pulsation reducing cooler B of this embodiment covers the circumferential periphery of the compressor A, the delivery passage 41 is provided in the form of a ring around the compressor A so that air discharged from the compressor A passes around the compressor A before it is expelled, and the jacket 43 covers the circumferential periphery of the compressor A so that it covers the circumferential periphery of the annular delivery passage 41.

An inflow port 41*c* at the upstream end of the delivery passage 41 is connected to the discharge port 36 of the compressor A, and a discharge port 41*d* at the downstream end of the delivery passage 41 is connected by a pipe or the like to a device to which the delivered air is to be supplied.

The delivery passage 41 of this embodiment is located in the form of a ring around the compressor A so that the delivered air passes around the compressor A before it is expelled.

The delivery passage 41 is bent by approximately 90° near the discharge port 36, as shown by the curved part $\alpha$ in FIG. 4, and then curves around the case 4 of the compressor A to guide air delivered through the discharge port 36 of the compressor A along the circumferential periphery of the case 4.

Two expansion chambers (first and second expansion chambers 44, 45), where the flow passage cross-sectional area increases, are provided in the delivery passage 41. The first and second expansion chambers 44, 45 are spaces where the flow passage cross-sectional area of the delivery passage 41 more than doubles.

The first expansion chamber 44 is provided extending over a wide range from the upstream end of the delivery passage 41 to the downstream end, and as shown by the expansion part $\beta$ in FIG. 1 the flow passage cross-section widens greatly in the vicinity of the connection with the discharge port 36 of the compressor A. The second expansion chamber 45 is formed by greatly widening the flow passage cross-section further, part-way along the first expansion chamber 44, as shown in FIG. 4. As a result, the pulsation of air guided into the delivery passage 41 decreases in the first expansion chamber 44 and the pulsation of the air is further reduced in the second expansion chamber 45.

The jacket 43 is provided to cover the annular delivery passage 41 around the compressor A from the outside, and in this embodiment, the jacket 43 covers the circumferential periphery and the front side (the left side in FIG. 1) of the compressor A. As a result, a cooling water passage 42 is formed as a space enclosed by the case 4 of the compressor A, the delivery passage 41 and the jacket 43. Cooling water flowing through the cooling water passage 42 and delivered air flowing through the delivery passage 41 located inside the cooling water passage 42 exchange heat, and the air delivered through the delivery passage 41 is cooled.

Also, cooling water flowing through the cooling water passage 42 removes heat from the case 4 of the compressor A (the rotor housing 7 and the cover 8), and limits the temperature of the compressor A. As a result, the compression space inside the compressor A, the lubricant space 9 and the bearings and so on are cooled.

The delivery passage 41 of this embodiment forms a substantially annular space around the circumferential periphery of the compressor A, and is provided by joining together a hollow passage vessel 41*a* and a first ring lid 41*b*. A seal ring 46 located at the joint between the passage vessel 41*a* and the first ring lid 41*b* and a seal ring 47 at the joint between the upstream end of the delivery passage 41 and the discharge port 36 of the compressor A prevent leakage of cooling water and air, respectively.

The jacket 43 covers the delivery passage 41 and the compressor A, and as shown in FIG. 1, is provided by joining together a cup-shaped vessel 43*a* and a second ring lid 43*b*. A seal ring 48 at the joint between the cup-shaped vessel 43*a* and the second ring lid 43*b*, a seal ring 49, at the joint between the second ring lid 43*b* and the case 4, and a seal ring 51, at the joint between an intake passage 50 and the intake opening 35 of the compressor A, prevent the leakage of cooling water.

As described above in detail, as a result of a discharge pulsation reducing cooler B being provided around the compressor A, delivered air flowing through the delivery passage 41 has heat removed from it and thus is cooled by cooling water flowing through the cooling water passage 42. In particular, because turbulence caused by pulsation arising in the delivery passage 41 promotes efficient heat exchange between the delivered air and the cooling water, the delivered air can be cooled efficiently in the delivery passage 41. This efficiently reduces the temperature of the delivered air supplied from the discharge pulsation reducing cooler B.

On the other hand, because the pulsation is reduced in the first and second expansion chambers 44, 45 provided in the delivery passage 41, the pulsation of the delivered air supplied downstream from the discharge pulsation reducing cooler B is suppressed, and the production of noise (emitted noise due to pulsation) in pipes and the like connected to points downstream from the discharge pulsation reducing cooler B is suppressed.

Because the delivery passage 41, where the pulsation occurs, is covered by the cooling water passage 42 and the jacket 43, the transmission of pulsation noise produced inside the delivery passage 41 is blocked by the cooling water passage 42 and the jacket 43, and the production of pulsation noise from the apparatus as a whole is suppressed.

Also, because the circumferential periphery of the compressor A is covered by the discharge pulsation reducing cooler B, operating noise of the compressor A (operating noise of the rotors 1, 2 and the rotation transmission mechanism 3) is also blocked by the cooling water passage 42 and the jacket 43, and the production of operating noise from the apparatus as a whole is suppressed.

Since the emission of operating noise is suppressed and because the emission of pulsation noise is prevented, the overall compressor noise is relatively low.

Since the lubricant space 9 is cooled by the cooling water flowing through the cooling water passage 42 inside the jacket 43, overheating of the rotation transmission mechanism 3 located inside the lubricant space 9 is prevented. Consequently, it is possible to cool the rotation transmission mechanism 3 at a low cost. Since the resistance to heat of the parts used in the rotation transmission mechanism 3 can be lowered, the cost of parts used in the rotation transmission mechanism 3 is reduced.

Because the case 4 of the compressor A is efficiently cooled by cooling water flowing through the cooling water passage 42, the rotor housing 7 is also cooled. Consequently, the temperature of the air delivered through the discharge port 36 is reduced.

Since both cooling of the delivered air and noise prevention are achieved inside the jacket 43 that covers the circumferential periphery of the compressor A, the gas compressor apparatus (the compressor A and the discharge pulsation reducing cooler B) is relatively compact in size. That is, with the gas compressor apparatus according to the present invention, it is possible to both cool delivered air and prevent noise in a simple manner that limits the size of the apparatus.

Also, because delivered air, which has been adiabatically compressed and heated in the compressor A is cooled by transferring heat to cooling water that flows through the delivery passage 41, the temperature of the delivered air is lowered without any oil being mixed with the delivered air. Consequently it is not necessary to provide an apparatus for removing oil, even if there are devices with low resistance to oil among equipment downstream of the compressor, and the construction is thus more simple than that of the related art.

Second Embodiment

The second embodiment will be described with reference to FIG. 6 and FIG. 7. In the second embodiment, only points of difference from the first embodiment discussed, and common reference numerals indicate parts with the same function.

The gas compressor apparatus of this embodiment includes a discharge pulsation reducing cooler B joined to the side face of the discharge port 36 on one side of a compressor A (for example, the cooler B is joined to face of the compressor A from which the most noise is emitted), and the jacket 43 has the shape of a vessel abutted against the compressor A.

Figure 6:
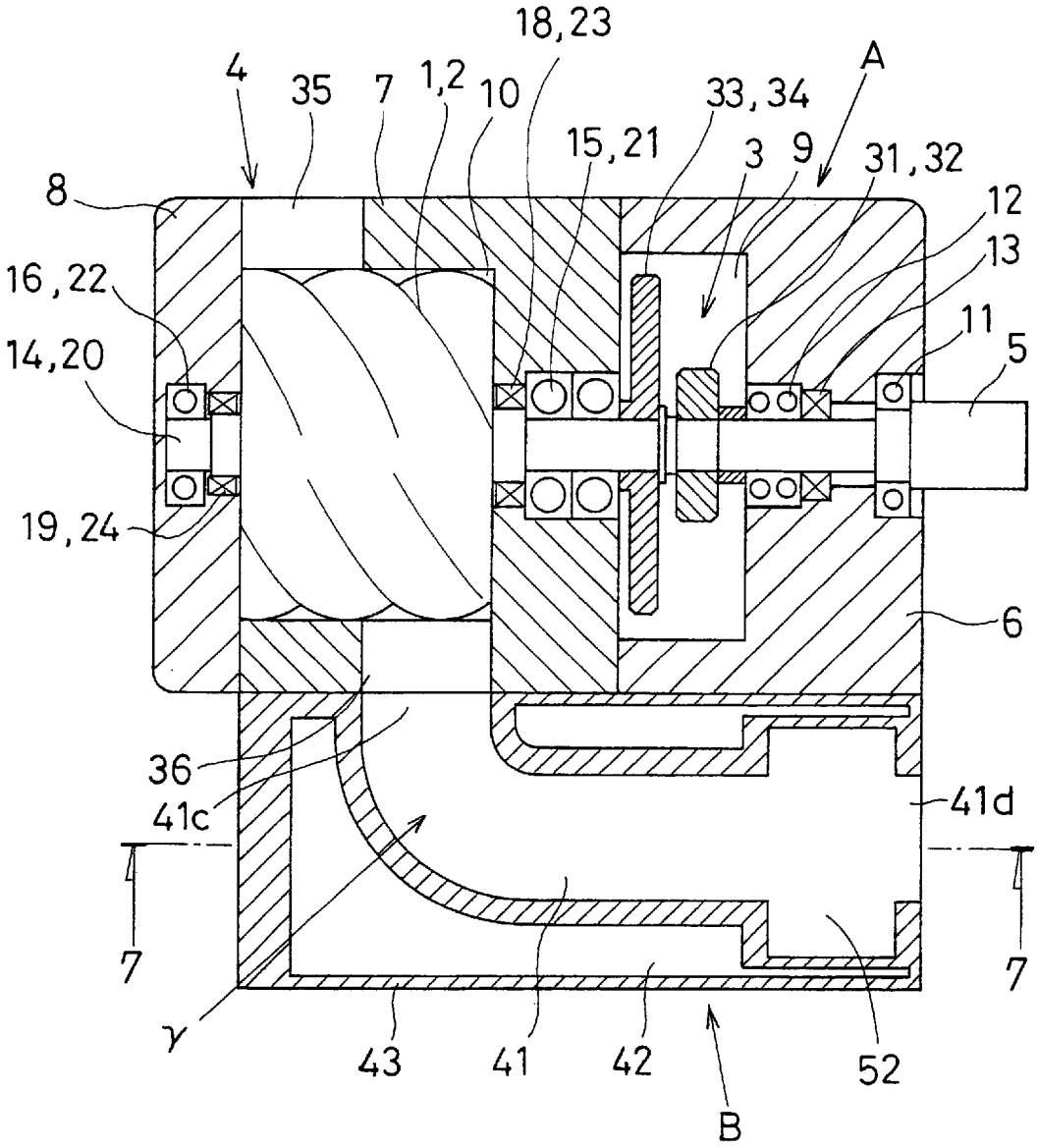
FIG. 6 is a sectional view of a gas compressor apparatus according to a second embodiment of the invention.
Figure 7:
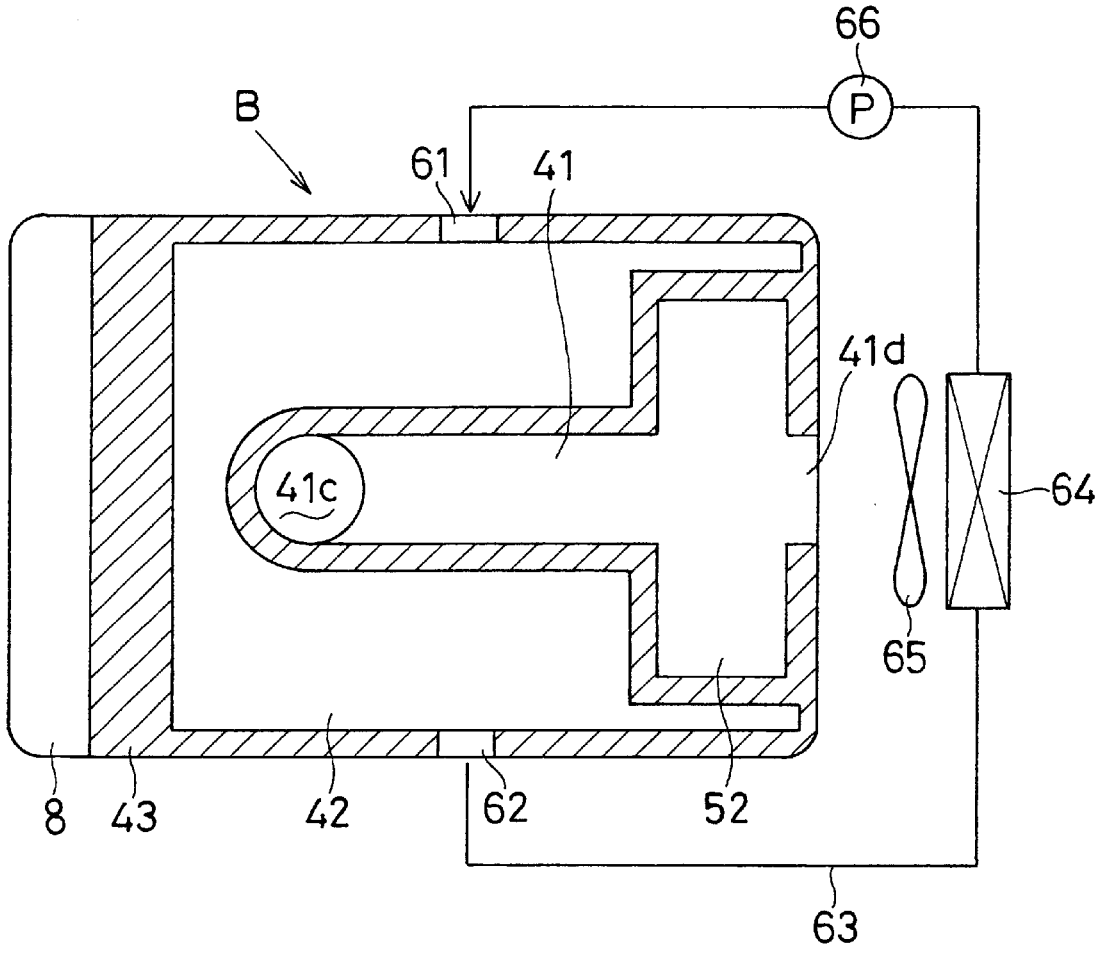
FIG. 7 is a sectional view on the line 7—7 in FIG. 6.

The delivery passage 41, in the vicinity of the discharge port 36 of the compressor A, is curved by approximately 90°, as shown by a curved part $\gamma$ in FIG. 6, and is directed so that air delivered through the discharge port 36 of the compressor A flows in an axial direction at the outer face of the case 4 of the compressor A.

In this embodiment, one expansion chamber 52 is provided in the downstream end of the delivery passage 41. This expansion chamber 52, like the first and second expansion chambers 44, 45 in the first embodiment, is a space where the cross-sectional area of the delivery passage 41 more than doubles.

As a result of the expansion chamber 52 in the downstream end of the delivery passage 41, the passage length over which turbulence arises due to pulsation is relatively long. That is, the passage length over which the heat exchange efficiency is high due to turbulence is long. Consequently, even if the passage length of the delivery passage 41 is relatively short, the delivered air is cooled efficiently.

As a result of the discharge pulsation reducing cooler B being located on the face of the compressor A from which there is the most noise is emitted, there is also a noise-reduction effect.

Also, whereas in the first embodiment, an example was shown in which the intake opening 35 of the compressor A was connected to external piping (for example, a filtered air supply pipe) through an intake passage 50 provided in the discharge pulsation reducing cooler B, in this second embodiment, the intake opening 35 of the compressor A can be connected to external piping directly, without going through an intake passage 50. As a result, compared to the first embodiment, the piping layout and connection structure are simpler.

Third Embodiment

Figure 8:
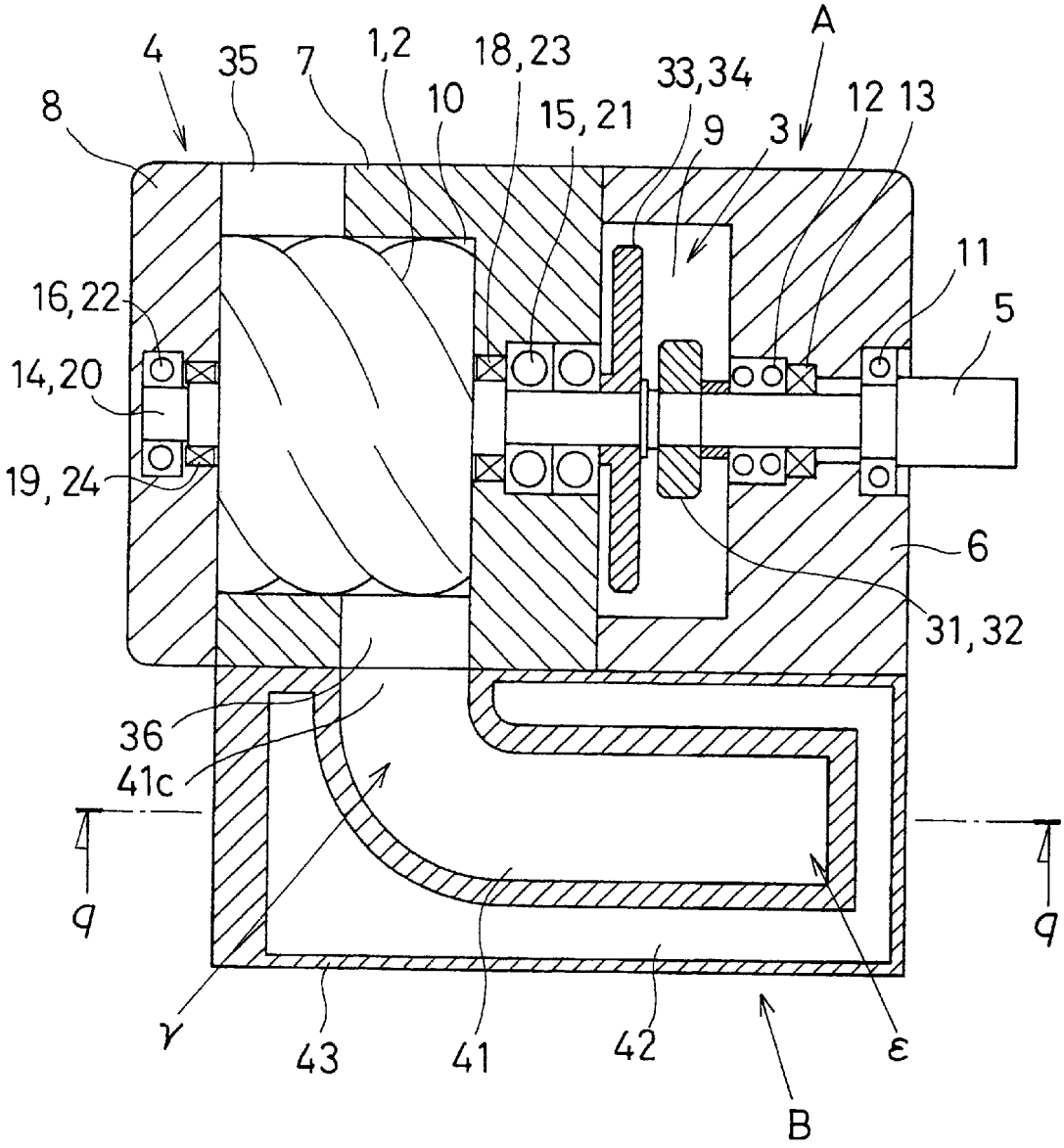
FIG. 8 is a sectional view of a gas compressor apparatus according to a third embodiment of the invention.
Figure 9:
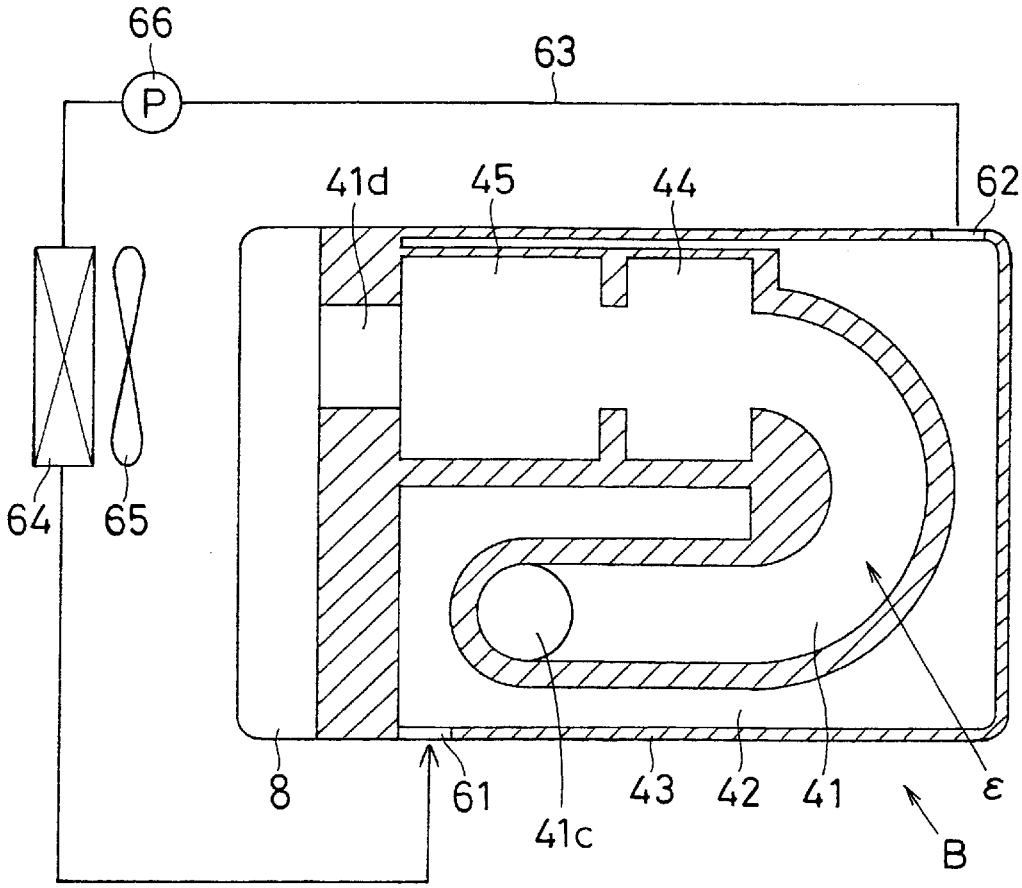
FIG. 9 is a sectional view on the line 9—9 in FIG. 8.

The third embodiment will now be described, with reference to FIG. 8 and FIG. 9. In the third embodiment, in the jacket 43 (that is, in the cooling water passage 42), the delivery passage 41 is bent through 180° to increase the passage length of the delivery passage 41 inside the jacket 43, as shown by the curved part $\epsilon$ in FIG. 8.

Thus, the passage length for cooling the delivered air is increased, while the discharge pulsation reducing cooler B remains relatively compact in size. Thus, it is possible to raise the delivered air cooling efficiency while still limiting the size of the discharge pulsation reducing cooler B.

In this embodiment, two expansion chambers (first and second expansion chambers 44, 45) having different lengths are provided near the downstream end of the delivery passage 41. The first and second expansion chambers 44, 45 are provided inside the cooling water passage 42, as in the first embodiment.

By providing first and second expansion chambers 44, 45, which have different lengths, in the delivery passage 41 and by providing the 180° curve (the curved part $\epsilon$) in the delivery passage 41, the pulsation reduction effect is still greater than in the first and second embodiments. Because the curved part $\epsilon$ is located inside the jacket 43, noise is reduced without having extreme projecting parts in the external shape of the apparatus.

Fourth Embodiment

Figure 10:
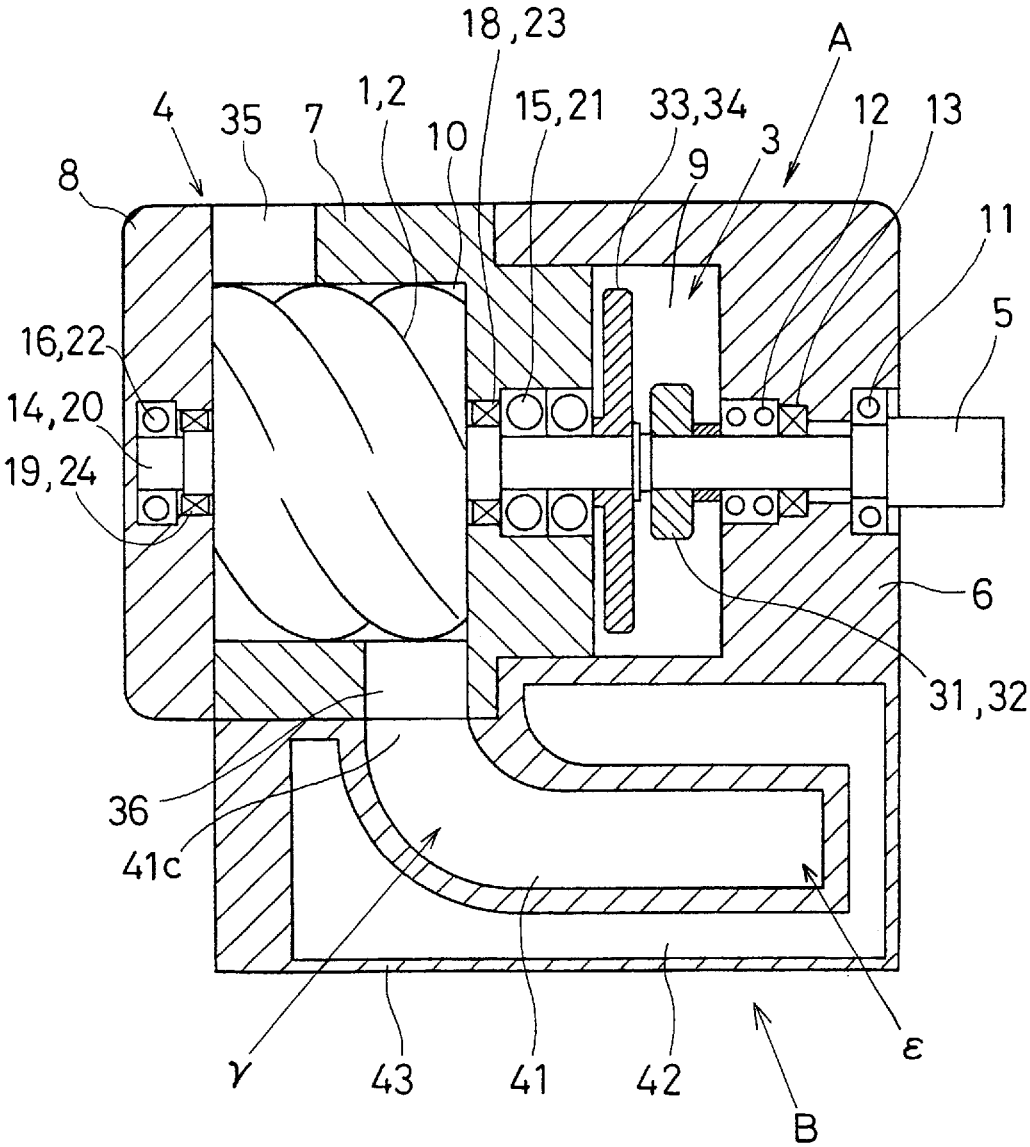
FIG. 10 is a sectional view of a gas compressor apparatus according to a fourth embodiment of the invention.

A fourth embodiment will now be described, with reference to FIG. 10. In the fourth embodiment, the jacket 43 of the discharge pulsation reducing cooler B, which is like that of the third embodiment, and the lubricated box 6 of the compressor A are made a single part (an integral part). Thus, the cooling water passage 42 cooling the delivered air also cools the lubricant space 9, and consequently, the construction of the gas compressor apparatus is simplified.

In the second and third embodiments, because the jacket 43 and the case 4 are in abutment, there is a possibility of there being places where there is no contact between them, and there is a possibility of the heat exchange efficiency falling due to such instances of lack of contact. In the fourth embodiment, on the other hand, no such places exist, and the case 4 is cooled efficiently by the cooling water flowing through the cooling water passage 42.

Fifth Embodiment

Figure 11:
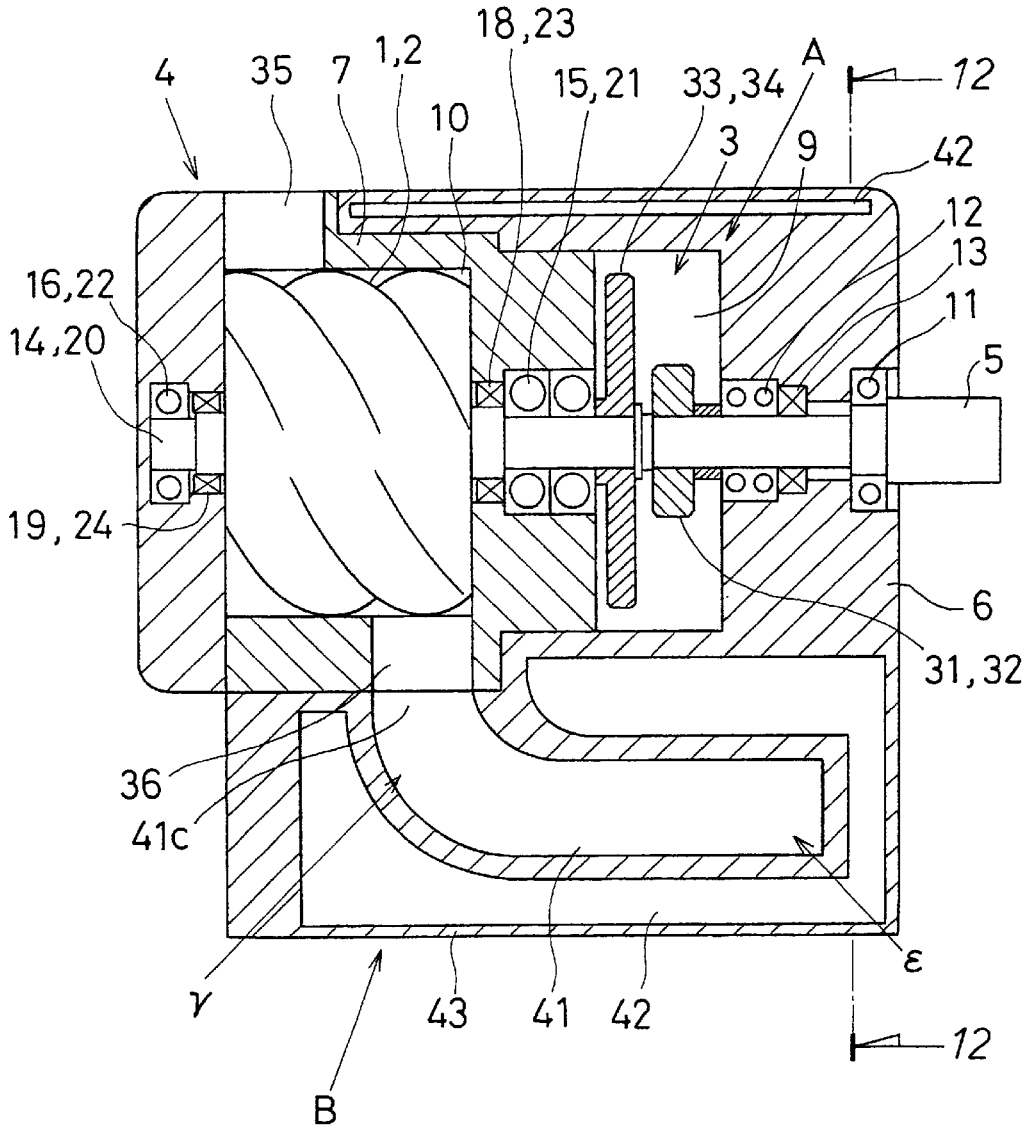
FIG. 11 is a sectional view of a gas compressor apparatus according to a fifth embodiment of the invention.
Figure 12:
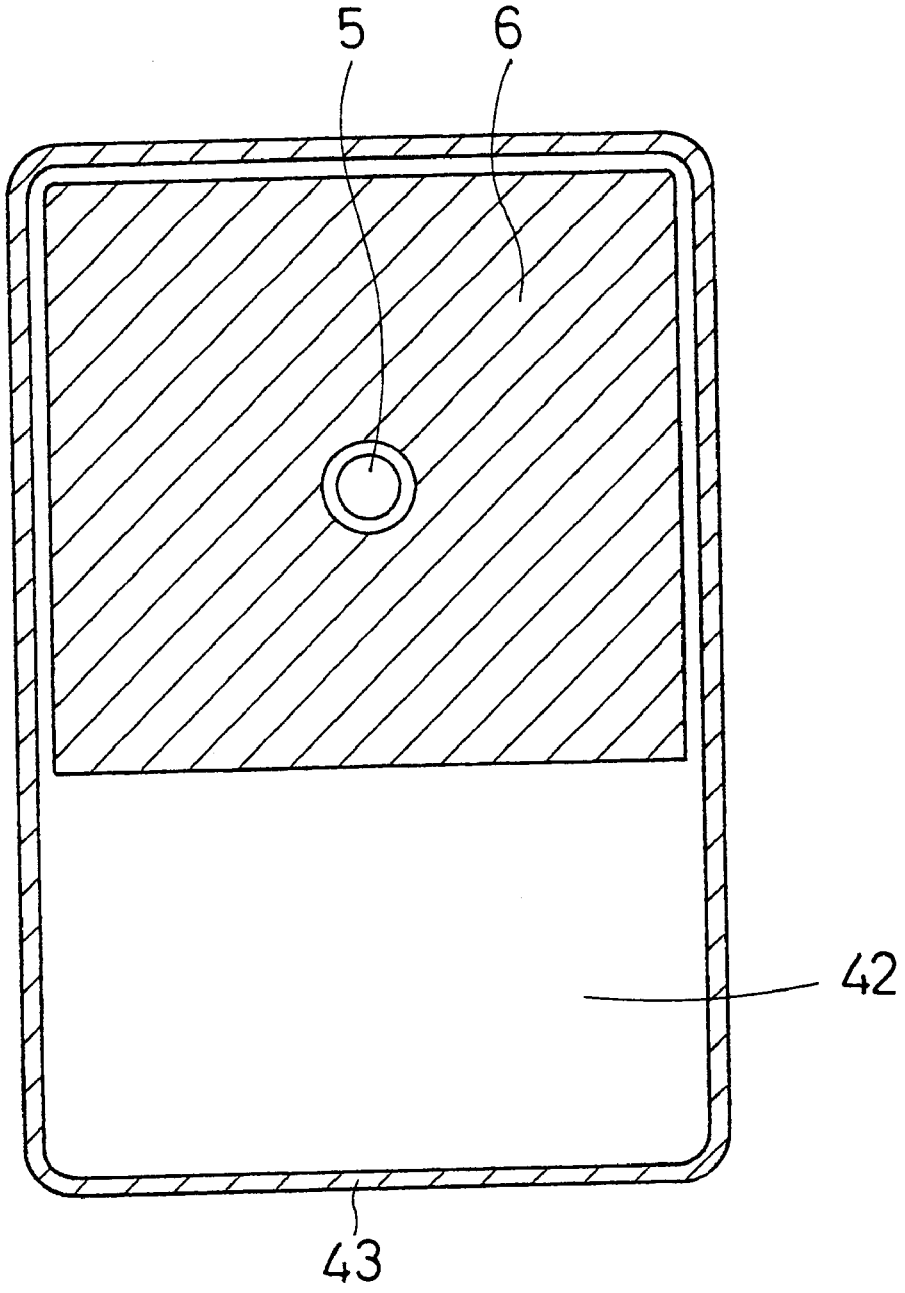
FIG. 12 is a sectional view on the line 12—12 in FIG. 11.

A fifth embodiment is shown in FIG. 11 and FIG. 12. In the fifth embodiment, the cooling water passage 42 is provided all the way around the circumferential periphery of the case 4, which is otherwise like that of the fourth embodiment.

Therefore, the compressor A is cooled efficiently, and the lubricant space 9 is cooled efficiently without using a dedicated cooling device for cooling the lubricant space 9. Consequently, it is possible to prevent the rotation transmission mechanism 3 located inside the lubricant space 9 from becoming abnormally hot. That is, the rotation transmission mechanism 3 can be cooled at a low cost.

Because the case 4 of the compressor A is cooled efficiently by the cooling water flowing through the cooling water passage 42, overheating of the rotor housing 7 is also prevented. Thus, the air delivered through the discharge port 36 is likewise not overheated.

Also, the operating noise of the compressor A is reduced by the cooling water passage 42 around the circumferential periphery of the case 4 and the jacket 43.

Sixth Embodiment

Figure 13:
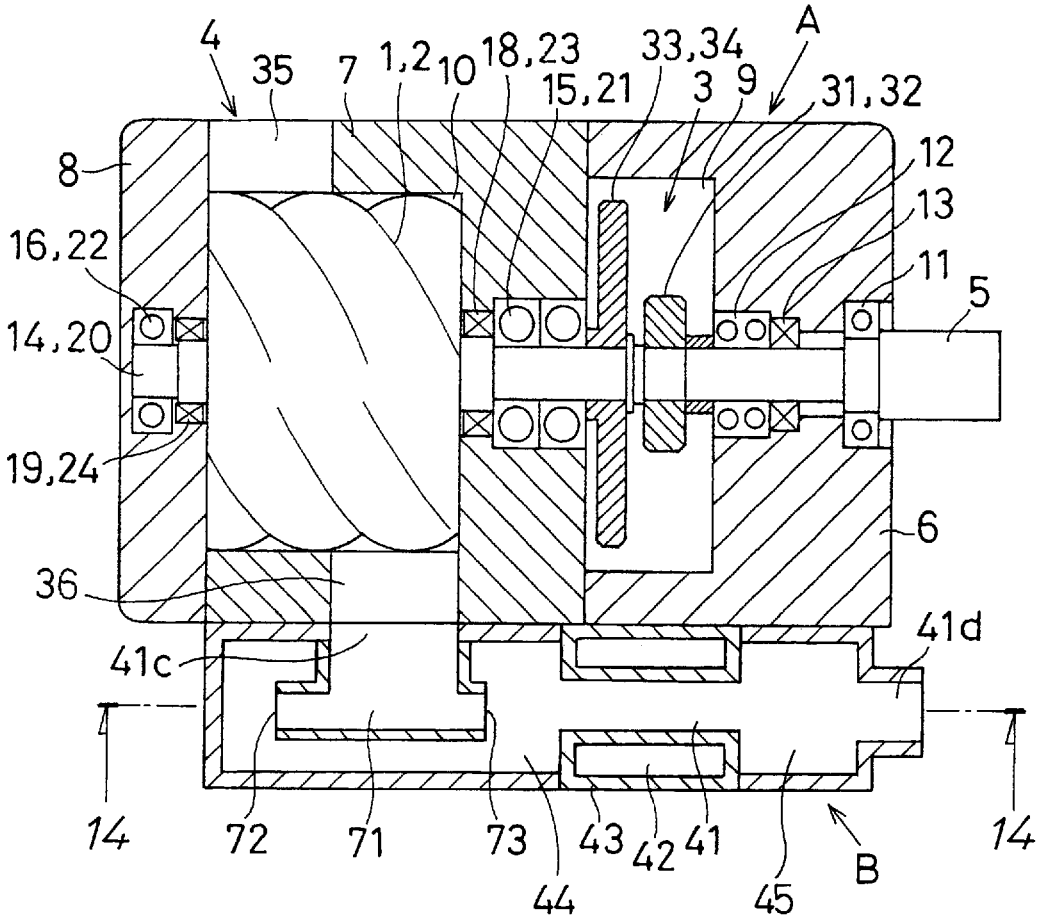
FIG. 13 is a sectional view of a gas compressor apparatus according to a sixth embodiment of the invention.
Figure 14:
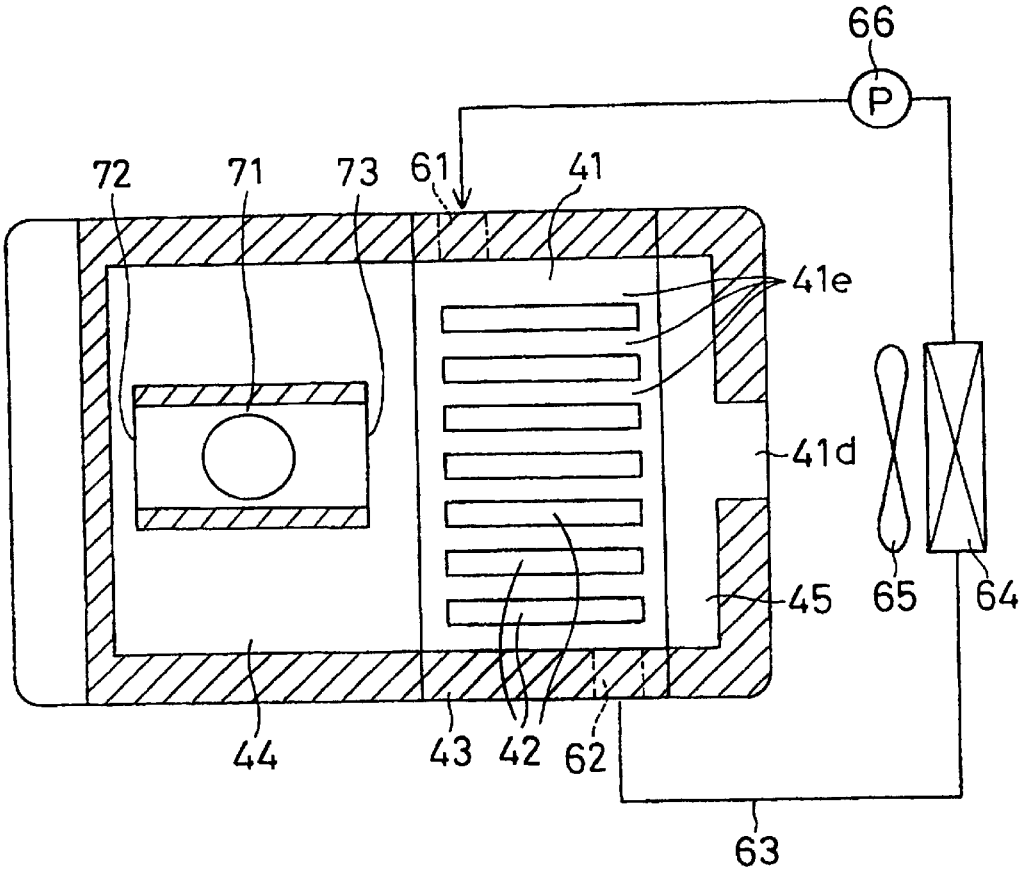
FIG. 14 is a sectional view on the line 14—14 in FIG. 13.

A sixth embodiment is shown in FIG. 13 and FIG. 14. In the embodiments described above, examples were shown in which an expansion chamber (the first and second expansion chambers 44, 45 and the expansion chamber 52) is covered by the jacket 43, and the cooling water passage 42 is formed between the expansion chamber and the jacket 43. Two expansion chambers are provided in the sixth embodiment (first and second expansion chambers 44, 45), which are not covered by the cooling water passage 42 and are in direct contact with the outside air. The delivery passage 41, except for the first and second expansion chambers 44, 45, is covered by the cooling water passage 42.

By not providing the cooling water passage 42 around the first and second expansion chambers 44 and 45, where the flow passage cross-section is large, but providing the cooling water passage 42 around the delivery passage 41, where the flow passage cross-section is small, the size of the discharge pulsation reducing cooler B is reduced, and the gas compressor apparatus as a whole is more compact.

Also, the first and second expansion chambers 44, 45, which are not covered by the cooling water passage 42, are provided at the upstream end and the downstream end of the delivery passage 41, which are not covered by the cooling water passage 42, and the volume of the first expansion chamber 44, which is at the upstream end, is larger than the volume of the second expansion chamber 45, which is at the downstream end.

By using two expansion chambers 44, 45 and making the volume of the first expansion chamber 44 larger than the volume of the second expansion chamber 45, the effect of reducing discharge pulsation, particularly at low frequencies, is improved.

In addition, an interfering muffler 71, which divides the through path of air passing through the inside of the first expansion chamber 44 at the upstream end into a plurality of paths of different lengths, is provided in the first expansion chamber 44. The interfering muffler 71 has a first orifice 72, for guiding air delivered through the discharge port 36 of the compressor A to the upstream end of the first expansion chamber 44, and a second orifice 73, for guiding it to the downstream side of the first expansion chamber 44, and the respective lengths of the through path from the first orifice 72 to the part of the delivery passage 41 covered by the cooling water passage 42 and the through path from the second orifice 73 to the part of the delivery passage 41 covered by the cooling water passage 42 are different.

By providing the interfering muffler 71 inside the first expansion chamber 44, it is possible to reduce discharge pulsation of a specific frequency, at which it is not possible to reduce discharge pulsation merely by changing the volumes of the two expansion chambers 44, 45.

Additionally, for the part of the delivery passage 41 covered by the cooling water passage 42, a tube-and-fin-type heat-exchanger structure is employed, to raise the efficiency of heat exchange with the cooling water flowing through the cooling water passage 42. FIG. 14 shows that the delivery passage 41 is divided into a plurality of parallel passage sections 41*e*, and each passage section 41*e* is adjacent to at least a portion of the cooling passage 42. The row of parallel rectangular boxes of FIG. 14 are the fins of the heat exchanger. Thus, the cooling liquid cools the passage sections 41*e*. By employing this heat-exchanger structure, it is possible to effect the distribution and collection of air to and from the tubes of the heat exchanger (the delivery passage 41 covered by the cooling water passage 42) on the downstream side of the first expansion chamber 44 and the upstream side of the second expansion chamber 45. Consequently, the construction of a discharge pulsation reducing cooler B reducing the discharge pulsation is efficiently simplified.

Other Embodiments

In the embodiments described above, the example of a compressor A for compressing air was used; however, the invention can also be applied to a compressor A for compressing some other fluid, such as hydrogen or the like.

In the foregoing embodiments, cooling water was used as an example of a cooling liquid; however, some other cooling liquid, such as oil or the like, may alternatively be used as the beat-carrying medium for cooling.

Although, in the embodiments described above, the example of a screw-type compressor using a pair of rotors 1, 2 was presented, the invention may alternatively be applied to a Roots-type compressor using Roots rotors as the rotors 1, 2 or a compressor of some other type for compressing and delivering a gas.

In the foregoing embodiments, examples in which a cooling water passage 42 through which cooling water flows is formed inside a jacket 43 were presented; however, alternatively, a cooling space may be formed within the jacket 43 for conducting cooling water.

We claim:

1. A gas compressor apparatus, comprising:

a compressor having a discharge pulsation; and a discharge pulsation reducing cooler, provided integrally with the compressor, wherein the cooler includes:

a delivery passage, wherein the delivery passage is divided into a plurality of passage sections through which gas that has been compressed by the compressor flows; and a jacket, which covers the passage sections, wherein a cooling passage is formed by the jacket such that every passage section is adjacent to at least a portion of the cooling passage, and cooling liquid is conducted by the cooling passage to cool the passage sections.

2. A gas compressor apparatus according to claim 1, wherein the discharge pulsation reducing cooler contacts an outer surface of the compressor.

3. A gas compressor apparatus according to claim 1, further comprising:

a radiator for cooling the cooling liquid;

a cooling liquid circulation path for guiding cooling liquid flowing through the cooling passage into the radiator and for returning cooled liquid from the radiator to the cooling liquid passage; and a pump for circulating the cooling liquid in the cooling liquid circulation path.

4. A gas compressor apparatus according to claim 1, wherein all the passage sections of the delivery passage are parallel to each other and are arranged in a single linear row in a direction generally perpendicular to a flow direction of the gas in the passage sections of the delivery passage.

5. A gas compressor apparatus according to claim 1, wherein the delivery passage includes an expansion chamber, in which the cross-sectional area of the delivery passage increases.

6. A gas compressor apparatus according to claim 5, wherein the expansion chamber is provided in a downstream end of the delivery passage.

7. A gas compressor apparatus according to claim 1, wherein the discharge pulsation reducing cooler comprises an expansion chamber, which is not covered by the jacket, wherein the cross sectional area of the expansion chamber is larger than that of the part of the delivery passage that is covered by the jacket.

8. A gas compressor apparatus according to claim 7, wherein the expansion chamber is a first expansion chamber and is provided on an upstream side of the cooling passage, and the cooler includes a second expansion chamber located on a downstream side of the cooling passage.

9. A gas compressor apparatus according to claim 8, wherein the volume of the first expansion chamber is larger than the volume of the second expansion chamber.

10. A gas compressor apparatus according to claim 1, wherein the compressor is a screw-type compressor, which compresses and delivers gas by rotation of a pair of mutually meshing rotors.

11. A gas compressor apparatus according to claim 10, wherein the screw-type compressor has a rotation transmission mechanism, for causing the rotors to rotate synchronously, and a lubricated box, which includes a lubricant space in which the rotation transmission mechanism is housed and a lubricant is sealed, wherein the lubricated box is at least partially covered by the cooling passage.

12. A gas compressor comprising a discharge pulsation reducing cooler, which is integral with the compressor, wherein:

the cooler includes a delivery passage through which gas that has been compressed by the compressor flows, and a jacket, which covers at least part of the delivery passage;

a cooling passage is formed by the jacket, and cooling liquid is conducted by the cooling passage to cool the delivery passage;

the delivery passage includes an expansion chamber, and the cross-sectional area of the delivery passage increases in the expansion chamber; and the cooler includes an interfering muffler, which divides the inside of the expansion chamber into a plurality of through paths, wherein the lengths of the through paths differ from one another.

* * * * *